US007101291B2

(12) United States Patent
Yamamoto

(10) Patent No.: US 7,101,291 B2
(45) Date of Patent: Sep. 5, 2006

(54) GOLF CLUB HEAD

(75) Inventor: Akio Yamamoto, Kobe (JP)

(73) Assignee: Sri Sports Limited, Kobe (JP)

( * ) Notice: Subject to any disclaimer, the term of this patent is extended or adjusted under 35 U.S.C. 154(b) by 0 days.

(21) Appl. No.: 10/668,294

(22) Filed: Sep. 24, 2003

(65) Prior Publication Data

US 2004/0067799 A1 Apr. 8, 2004

(30) Foreign Application Priority Data

Sep. 25, 2002 (JP) ..... 2002-279541

(51) Int. Cl.
*A63B 53/04* (2006.01)
*A63B 53/06* (2006.01)

(52) U.S. Cl. ..... 473/345; 473/324

(58) Field of Classification Search ..... 473/312, 473/324–350; 29/509, 512, 522.1
See application file for complete search history.

(56) References Cited

U.S. PATENT DOCUMENTS 1,889,743 A * 12/1932 Buhrke et al. ..... 473/312
3,429,576 A * 2/1969 Ikeda ..... 473/241
3,625,513 A * 12/1971 Ballmer ..... 473/310
4,220,336 A * 9/1980 Kochevar ..... 473/312
5,913,735 A * 6/1999 Kenmi ..... 473/338
5,935,019 A * 8/1999 Yamamoto ..... 473/338
5,967,905 A * 10/1999 Nakahara et al. ..... 473/345
5,976,033 A * 11/1999 Takeda ..... 473/334
6,033,321 A * 3/2000 Yamamoto ..... 473/338
6,056,649 A * 5/2000 Imai ..... 473/328
6,319,149 B1 * 11/2001 Lee ..... 473/342
6,379,265 B1 * 4/2002 Hirakawa et al. ..... 473/338
6,524,198 B1 * 2/2003 Takeda ..... 473/338

FOREIGN PATENT DOCUMENTS

JP 6-154367 A 6/1994
JP 10-248964 A 9/1998
JP 11-128415 A 5/1999
JP 2001-276287 A 10/2001

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head which includes a main body provided with a socket, and a weight member disposed in the socket, wherein the socket is a tubular portion extending to the inside of the main body and deforming a through-hole extending therethough, the weight member having a main portion accommodated by the through-hole, and secured in the through-hole by a crushable portion which, after being crushed by the application of pressure causes the socket to expand, locking the weight member in the socket.

21 Claims, 9 Drawing Sheets

GOLF CLUB HEAD

This nonprovisional application claims priority under 35 U.S.C. § 119(a) on Patent Application No(s). 2002-279541 filed in JAPAN on Sep. 25, 2002, which is(are) herein incorporated by reference.

BACKGROUND OF THE INVENTION

The present invention relates to a golf club head, more particularly to the structure of a weight member and a socket therefor.

In golf club heads, a weight member separate from the main body of the club head is often used in order to obtain desired weight distributions to adjust, for example, the gravity point, the sweet spot, the moment of inertia and the like of the golf club head (for example).

In case the of metal wood-type hollow club heads, on the other hand, light-weight, strong metal materials such as titanium alloys have been widely used in recent years. The use of such materials can decrease the wall thickness of the golf club head. Therefore, if a large-sized, heavy weight member can be used in a club head whose wall thickness is relatively thin, then the design freedom will be remarkably increased.

In the laid-open Japanese patent application P2001-276287A, a method of securing a weight member to the main body of the golf club head is disclosed, wherein, as shown in FIGS. 14(*a*) and 14(*b*), a cylindrical weight member (c) is positioned in a cylindrical socket (e), with its smaller diameter end portion (c2) protruding from the inner end (e1) of the socket through a smaller diameter opening formed at the inner end (e1) of the socket. The protruding portion (c2) is pressed to deform, expanding over the surface of the inner end (e1) of the socket. In order to facilitate such deformation, the end of the protruding portion (c2) is provided with a hollow (c3).

When the size of the weight member is increased, the pressing force necessary to deform it as indicated above increases at an accelerating pace. Therefore, in this method, near the base of the socket, as indicated by the circles in FIG. 14(*b*), the wall (a) is subjected to a large stress due to the large compressive stress transferred by the socket as indicated by arrows, which results in unfavorable residual stress or strain or, in the worst case, cracks in the finished article.

SUMMARY OF THE INVENTION

It is therefore, an object of the present invention to provide a golf club head, in which, even if the size of the weight member is relatively large, the weight member is firmly and easily secured to the head main body of the golf club without the above-mentioned drawbacks, whereby the design freedom is greatly increased.

According to one aspect of the present invention, the golf club head comprises a main body provided with a socket, and a weight member disposed in the socket, wherein the socket loc a tubular configuration extending towards the inside of the main body and having a through-hole extending therethough, the weight member containing a main portion accommodated in the through-hole, said weight member being secured in the through-hole by crushing a crush portion, which is formed at the inner end of the main portion of the weight member within the region of the inner end, to protrude from the inner end of the socket, into the main portion so that the main portion expands, pressing on the surface of the through-hole.

DESCRIPTION OF THE PREFERRED EMBODIMENTS

Figure 1:
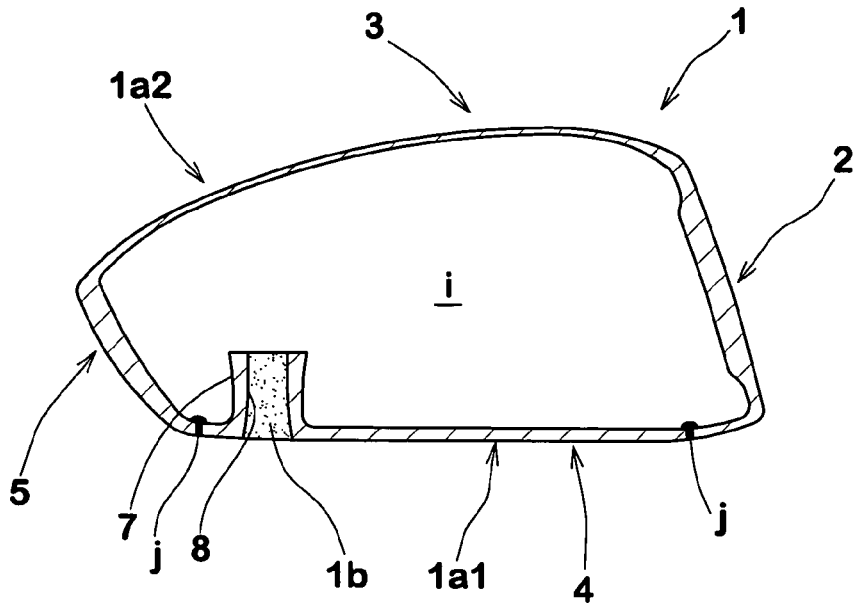
FIG. 1 is a cross sectional view of a wood-type golf club head according to the present invention taken along line A—A of FIG. 2.
Figure 2:
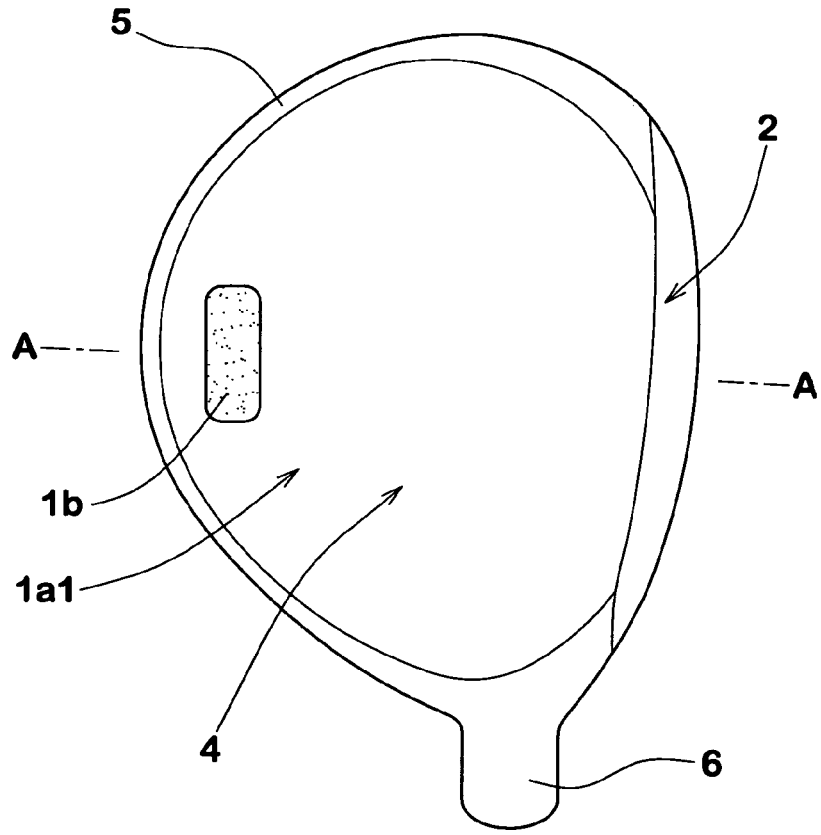
FIG. 2 is a bottom view thereof.
Figure 3:
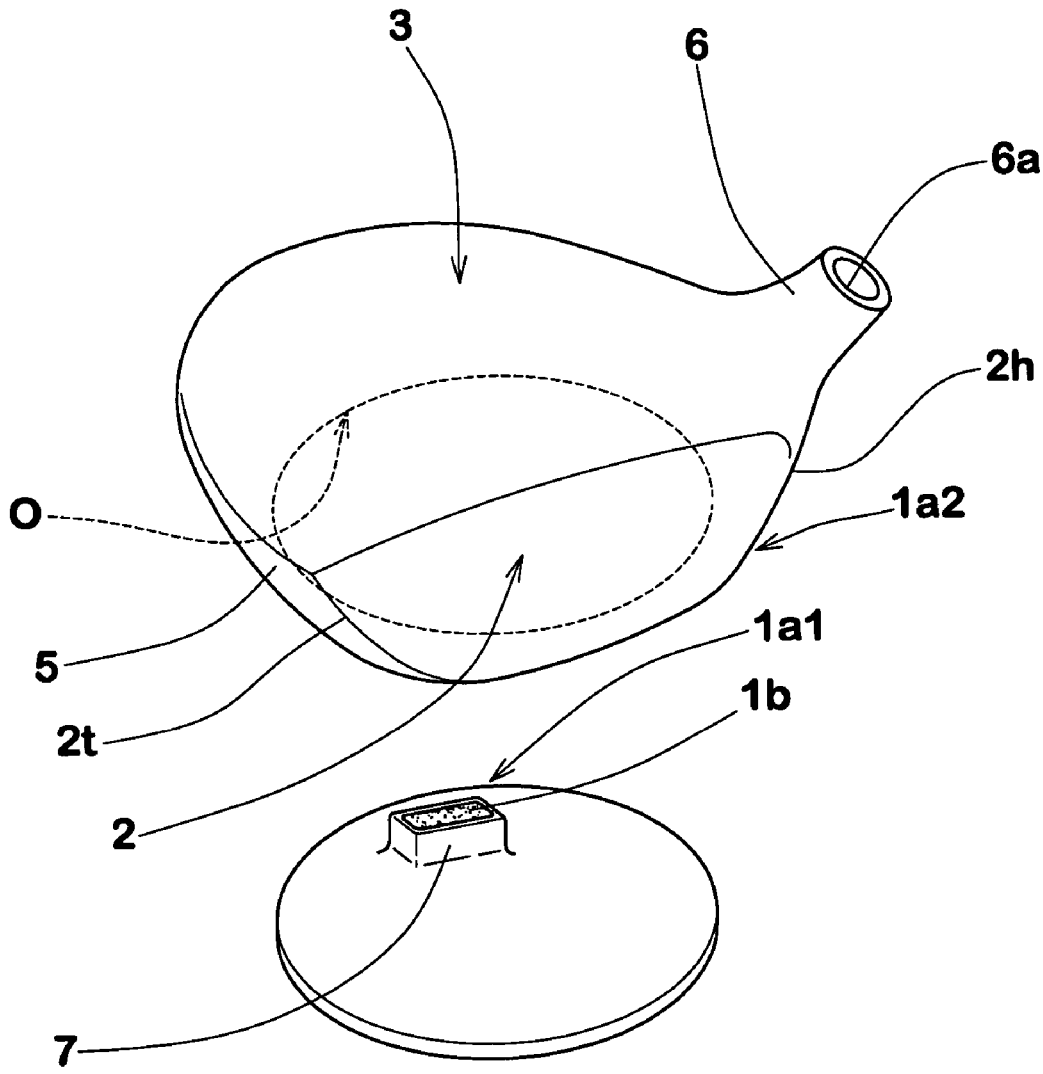
FIG. 3 is an exploded perspective view of the golf club head showing an exemplary two-piece structure comprising a hollow main part and a platy part to which a weight member is attached.

In FIGS. 1, 2 and 3, an embodiment of the present invention is a metal wood-type hollow golf club head 1 for a fairway wood.

The wood-type golf club head 1 comprises a face portion 2 whose front face defines a club face for striking a ball, a crown portion 3 intersecting the club face at the upper edge thereof, a sole portion 4 intersecting the club face at the lower edge thereof, a side portion 5 between the crown portion 3 and sole portion 4 which extends from a toe-side edge 2*t* to a heel-side edge 2*h* of the club face through the back face of the club head, and a neck portion 6 to be attached to an end of a club shaft (not shown), the neck portion 6 provided on the top thereof with a shaft inserting hole 6*a* for accommodating a club shaft.

The hollow (i) of the head 1 is a void in this embodiment, but it is also possible to dispose therein a filler made of a resin, elastomer or the like in a form of a solid or a foam.

According to the present invention, the club head 1 comprises a main body and a weight member 1*b*. In this embodiment, the club head 1 comprises a hollow main part 1*a*2 having an opening O, a platy part 1*a*1 welded thereto so as to close the opening O, and a weight member 1*b* attached to the platy part 1*a*1, whereby the main body is made up of the hollow main part 1*a*2 and platy part 1*a*1.

FIG. 3 shows an example of such a structure. In this example, in order to make the center of gravity of the head lower and deeper, the weight member 1*b* is disposed in the sole portion 4. The opening O is formed in the bottom of the hollow main part 1*a*2, and the platy part 1*a*1 is welded to the bottom of the main part 1a2. The platy part 1a1 in this example forms almost the entirety of the sole portion 4 (thus hereinafter, the "sole plate"). The hollow main part 1a2, accordingly forms the remaining portions, namely, the face portion 2, crown portion 3, side portion 5 and neck portion 6. As shown in FIG. 1, at the weld J, two parts 1a1 and 1a2 are butt welded.

To make the main part 1a2 and platy part 1a1, various metal materials such as titanium alloys, aluminum alloys, stainless steel, steel the like can be used. Further, it is also possible to use a fiber reinforced resin to form a part of the head 1. In this embodiment, each of the hollow main part 1a2 and platy part 1a1 is made of a titanium alloy using a lost wax precision casting method. By the way, depending on the material, shape, and region of the part to be formed, another method, e.g. forging, press molding and the like may be also employed.

In order to secure the weight member 1b, a socket 7 into which the weight member 1b fits is integrally formed on the platy part 1a1 (in this embodiment, on the sole portion 4 at a position biased towards the back end thereof).

The socket 7 is a tubular portion having a substantially constant wall thickness and protruding from the inner surface of the platy part 1a1 or the inner surface of the head to the hollow (i). The socket 7 has a through-hole 8 having an opening to the inside (i) of the head 1 and an opening to the outside of the head.

FIGS. 2, 3, 4 and 5 show an example of the socket 7. In this example, the through-hole 8 has a generally rectangular cross sectional shape with rounded corners, and the cross sectional shape is substantially constant throughout the depthwise direction. Aside from such a rectangle, various shapes, e.g. a square with rounded corners, a circle, a oval, a triangle with rounded corners, and the like can be used.

On the other hand, the weight member 1b is made of a plastically deformable, relatively heavy material M. For example, tungsten, a tungsten alloy, copper, a copper alloy, brass, stainless steel and the like can be used. Usually, a metal material whose specific gravity is larger than the platy part 1a1 and main part 1a2 is used. Especially, a tungsten-nickel alloy is preferably used. The specific gravity is preferably in the range of from 8 to 20, more preferably about 12 to about 18.

The weight member 1b is provided at the inner end of its main portion 10 with a crushable portion 11.

The main portion 10 has a cross sectional shape which is almost the same but slightly smaller than that of the through-hole 8 so as to snuggly fit in the through-hole 8. For the socket 7 shown in FIG. 4, therefore, a rectangle with rounded corners is used as the cross section shape of the main portion 10.

The depth H of the main portion 10 is the same as or slightly larger (but very small as compared with "h") than the depth Ha of the through-hole 8, namely, the depth H is substantially the same as the depth Ha.

The crushable portion 11 is a protrusion formed at the inner end 12 of the main portion 10 and tapering towards its end. Around the crushable portion 11, a flat surface 14 remains while defining the inner end 12.

Figure 4:
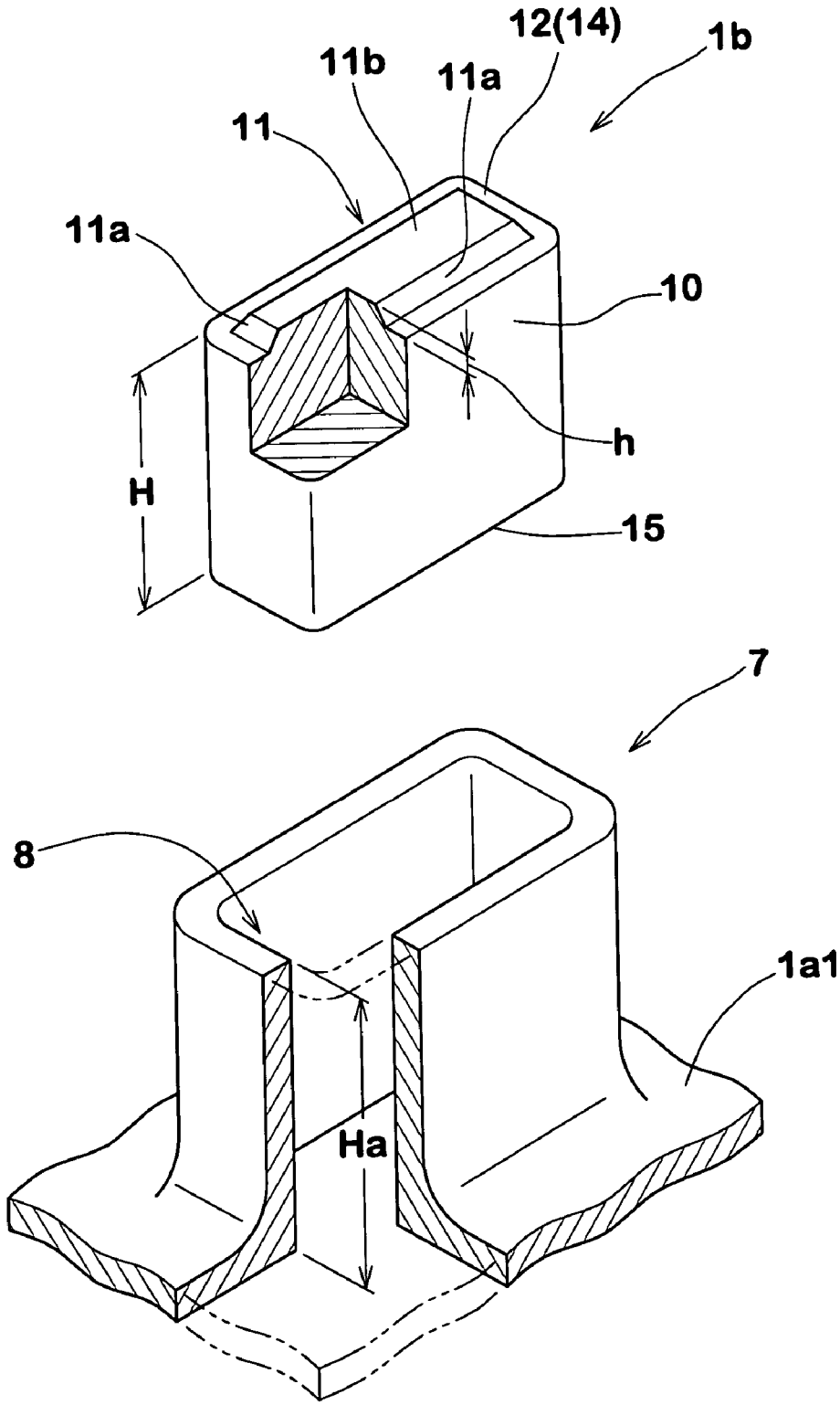
FIG. 4 is an enlarged perspective view showing a weight member with a crush portion and a socket therefor.

FIG. 4 shows an example of the crushable portion 11, which has a trapezoidal cross sectional shape in almost any cross section which is parallel with the depthwise direction (H) of the weight member 1b from the outer end 15 to the inner end 12. Thus, in this example, the top surface 11b of the crushable portion 11 is substantially flat and parallel with the above-mentioned flat surface 14.

Further, in any cross section which is perpendicular to the depthwise direction, the crushable portion 11 has a similar figure to the contour of the main portion 10 at the inner end 12 which figure becomes smaller from its basal plane at the end 12 to the top surface 11b. Thus, in this particular case where the contour is a rectangle, the top surface 11b is also a rectangle, and the crushable portion 11 has four side faces 11a inclined towards the center of the weight member 1b at an angle of from 40 to 60 degrees with respect to the flat surface 14.

Figure 5:
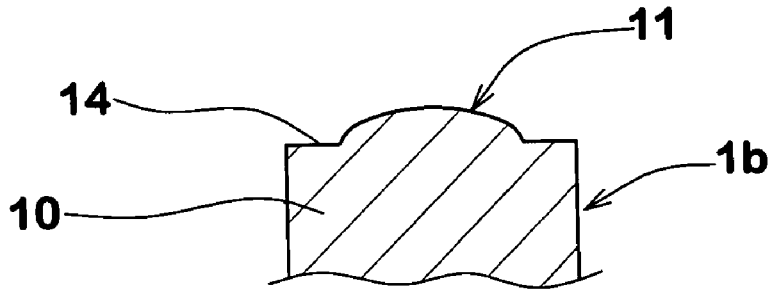
FIGS. 5 and 6 are cross sectional views each showing another example of the crush portion.

Aside from the trapezoidal cross sectional shape where the top surface is flat, another shape where the top surface is slightly swelled may be used as well. FIG. 5 shows an example of such a shape which is defined by a comparatively flat arc, e.g. a part of an ellipse, a part of a circle and the like.

Figure 6:
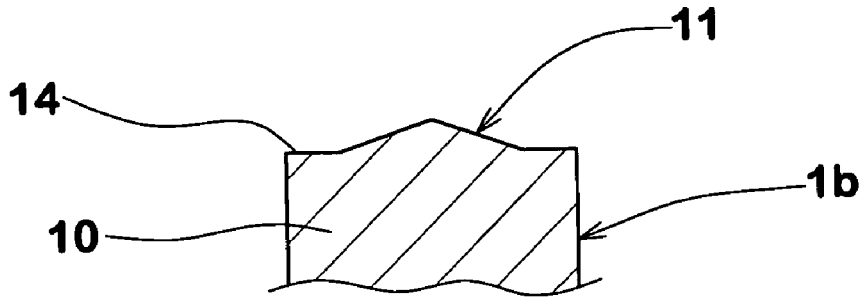

Further, as shown in FIG. 6, a comparatively flat triangular shape such as isosceles triangle may be used when the central region is higher than the peripheral region (14).

When the cross sectional shape of the main portion 10 of the weight member 1b is a rectangle, an oval or the like, the crushable portion 11 may be formed to have such a cross sectional shape along a direction parallel to the long sides or major axis of the cross sectional shape of the main portion.

Figure 7A:
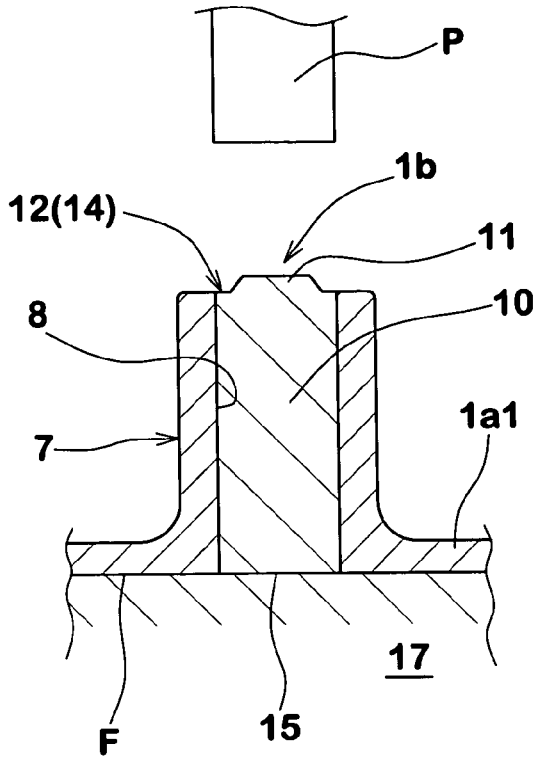
FIGS. 7(*a*) and 7(*b*) are cross sectional views of the weight member put in the socket showing the states before and after the crush portion is crushed.
Figure 7B:
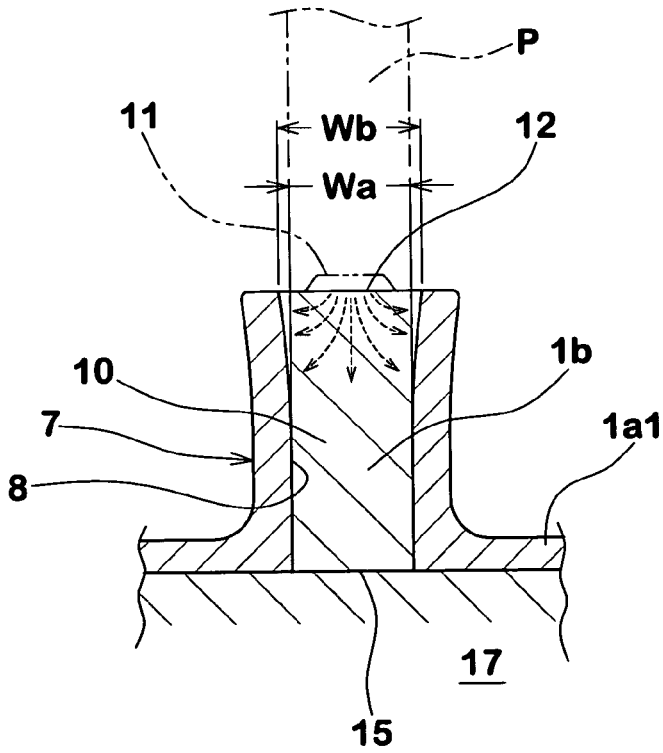

The weight member 1b, as shown in FIG. 7(*a*), is put into the socket 7 of the platy part (sole plate) 1a1. The platy part 1a1 is put on a mold 17 to hold the platy part 1a1 while keeping the weight member 1b in its place such that the outer end or surface 15 of the main portion 10 aligns with the outer surface F of the platy part 1a1. Then, as shown in FIG. 7(*b*), using a press die P, the crushable portion 11 is crushed towards the main portion 10 as indicated by arrows. At this time, due to the opening of the through-hole 8 at the surface F, the mold 17 can support and press the outer end 15 in the counter direction. In this example, the entire volume is crushed into the main portion 10 so as to become flat with the inner end of the socket 7.

As the weight member 1b, crushed in the through-hole 8, expands radially near the inner end 12, the through-hole 8 is radially expanded, accordingly, such that the expansion becomes larger towards the end of the tubular portion, whereby the end of the tubular portion flares and the weight member 1b is tightly locked.

Then, the assembly of the platy part 1a1 and weight member 1b is welded to the main part 1a2 to form the head 1.

It is preferable that the expansion Wb−Wa at the inner end 12 is more than 0.3 mm, but not more than 0.6 mm. More definitely, when the dimension is measured, before the crushable portion 11 is crushed, across the contour shape of the inner end 12 of the weight member 1b, passing the centroid Sg1 of the contour shape in every direction around the centroid Sg1, the minimum Wa thereof shows a difference (Wb−Wa) of not less than 0.3 mm but not more than 0.6 mm from the dimension Wb measured in the same direction across the deformed contour shape after the crushable portion 11 is crushed.

To achieve the desired radial expansion, the protruding height h of the crushable portion 11 from the inner end 12 is set in the range of from 0.5 to 1.5 mm. If the height h is more than 1.5 mm, it becomes difficult to radially expand the main portion from a suitable deep position and as a result, the flared part becomes shorter which results a the reduced engage force, OR a fracture is liable to occur at the end of the socket because an extremely large crushing force is required. If the height h is less than 0.5 mm, it is difficult to obtain the desired sufficient engaging force.

On the other hand, if the above-mentioned flat surface 14 around the crushable portion 11 is too narrow in width, fracture is liable to occur at the end of the socket. If the width is too wide, it becomes difficult to obtain the necessary expansion. Therefore, it is preferable that the width of the flat surface 14 is not less than 0.8 mm, preferably not less than 1.5 mm, but not more than 2.5 mm, preferably not more than 2.0 mm.

Further, if the wall thickness of the socket 7 is too small, fracture is liable to occur at the end of the socket. If too large, it becomes difficult to obtain the appropriate flared portion. Although the desirable range somewhat varies depending on the material, it is preferable that the wall thickness of the socket 7 is set in a range of from about 1.5 to about 3.0 mm.

Figure 8A:
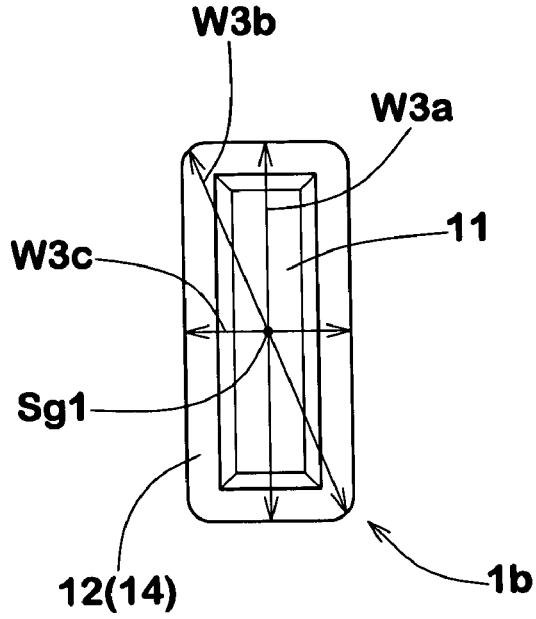
FIGS. 8(*a*) and 8(*b*) are plan views of the weight member for explaining various dimensions of the main portion and crush portion.
Figure 8B:
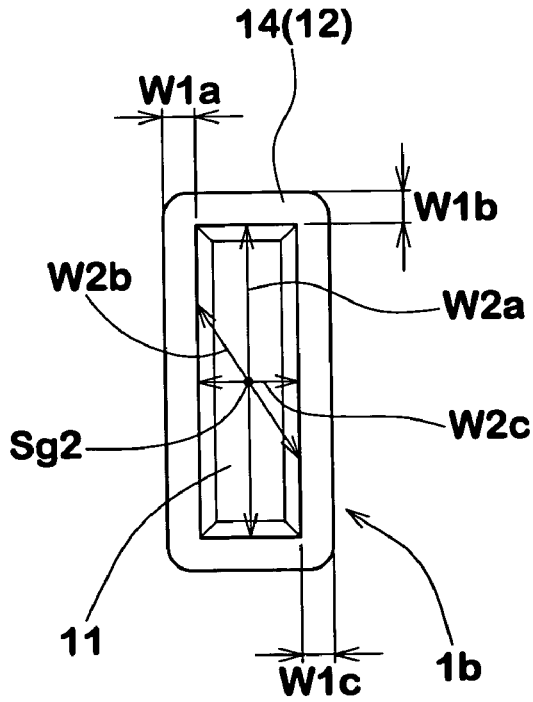

Given that average width W3 of the inner end 12 is the average of dimensions (W3a, W3b, W3c—) which are, as shown in FIG. 8(*a*), measured across the shape of the inner end 12, passing through the centroid Sg1 of the shape, for every predetermined small angle (for example 10 degrees) around the centroid Sg1, the ratio (W3/h) of the average width W3 to the above-mentioned height h is preferably set in the range of from 7 to 20, more preferably 9 to 15.

Further, similarly to the width W3, when the average width W2 of the basal plane of the crushable portion 11 is defined as the average of dimensions (W2a, W2b, W2c—) which are, as shown in FIG. 8(*b*), measured across the shape of the basal plane, passing through the centroid $Sg_2$ of the shape, for every predetermined small angle (for example 10 degrees) around the centroid $Sg_2$, the ratio (W2/W1) of the average width W2 to the average W1 of widths (W1a, W1b, W1c—) of the flat surface 14 is preferably set in the range of 5 to 9, more preferably 6 to 8.

Figure 9:
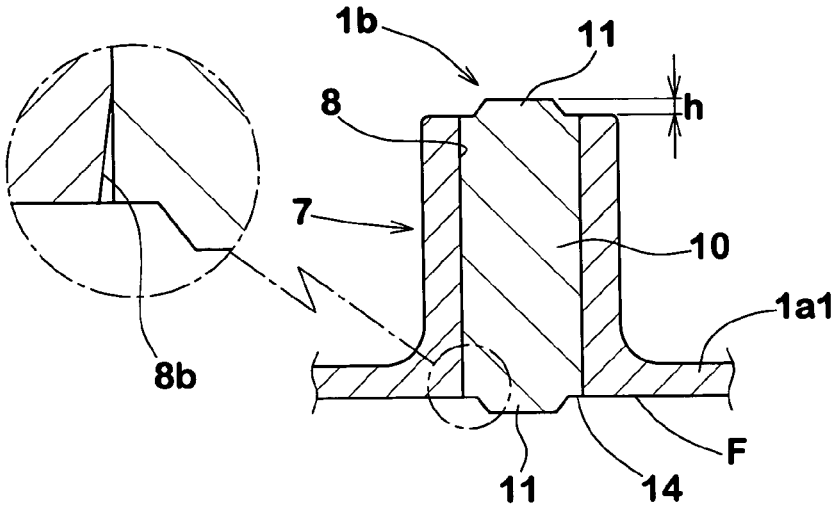
FIG. 9 is a cross sectional view showing another example of the weight member.

FIG. 9 shows a modification of the above-mentioned weight member 1*b*, wherein a crushable portion 11 is formed at the outer end 15 in addition to the inner end 12 so as to form a flared part on each side of the weight member 1*b*. In this case, it is preferable that the through-hole 8 is provided at the outer end with a gradually expanded part 8*b* in advance.

Figure 10:
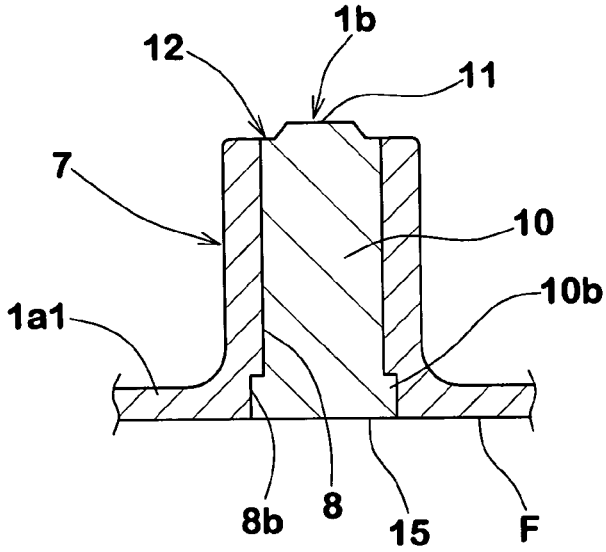
FIG. 10 is a cross sectional view showing another example of the weight member and socket therefor.

FIG. 10 shows a further modification of the above-mentioned weight member 1*b*, wherein to facilitate the positioning of the weight member, a flange 10*b* is provided at the outer end 15 of the main portion 10. The through-hole 8 is accordingly, provided immediately inside the outer end with a stepped expanded part 8*b*. The expanded part 8*b* is shaped to accommodate the flange 10*b* so as to make these surfaces flat.

Figure 11:
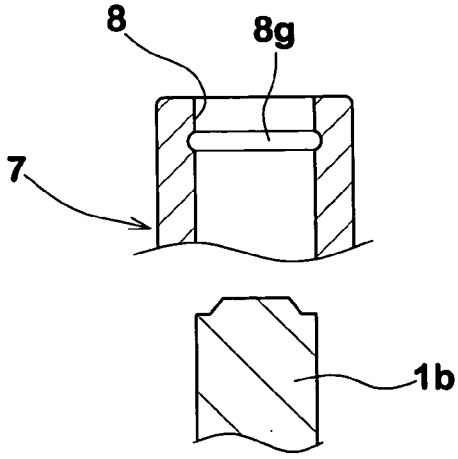
FIG. 11 is a cross sectional view showing still another example of the socket.

FIG. 11 shows a modification of the above-mentioned through-hole 8, wherein, in order to increase the engaging force between the weight member 1*b* and socket 7, the inner surface of the through-hole 8 is provided with a continuously or discontinuously extending circumferential groove 8*g*. The position of the circumferential groove 8*g* is set in the flaring part at a small distance from the end of the hole.

Instead of a discontinuous groove 8*g*, it is also possible to provide a plurality of holes or dents arranged circumferentially at small intervals.

The depth of the groove, dent or hole is set in the range of 0.5 to 1.5 mm.

Comparison Tests

Several kinds of weight members were made, changing the crushable portion only as shown in Table 1. The main portion 10 has, as shown in FIG. 4, a 19.9×4.9 mm rectangular cross sectional shape with corners rounded in a radius R of 0.5 mm, and a depth H of 6 mm. The material of the weight member is a tungsten-nickel alloy having a specific gravity of 14.5.

Using these weight members in combination with the sole plate 1*a*1 shown in FIG. 3, the weight member is put in the socket and, by crushing the crushable portion as explained above, they are fixed to each other. The socket is formed on the sole plate 1*a*1 and as shown in FIG. 4, the through-hole had a depth Ha of 6 mm and a 20×5 mm rectangular cross sectional shape with rounded corners at a radius R of 0.5 mm for accommodating the main portion of the weight member.

50 pieces of such assembly are made with respect to each of the weight members.

The flared end portion of the socket is checked for fracture. The percentage of occurrence of fracture is shown in Table 1. The engaging force between the weight member and socket is measured as a force at which the weight member starts to move relatively to the socket when the inner end of the weight member is pushed towards the outer end. The measured force is indicated by an index based on Ex.1 being 100. The larger the index number, the larger the engaging force.

TABLE 1

Figure 12:
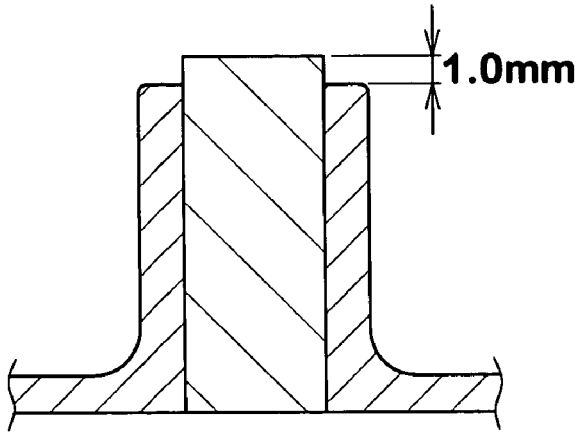
FIGS. 12 and 13 are cross sectional views each showing a weight member used in the undermentioned comparison test.
Figure 13:
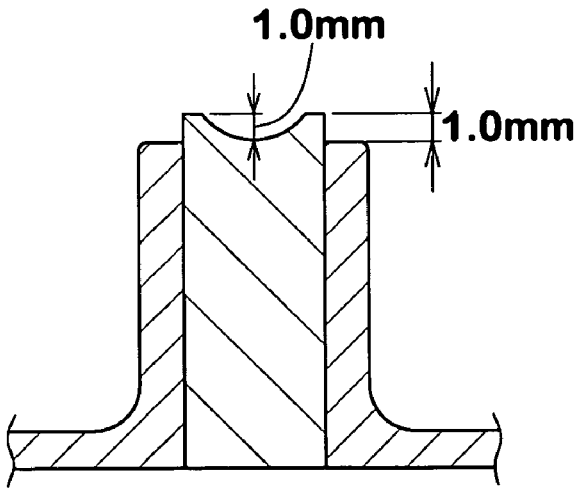
Figure 14A:
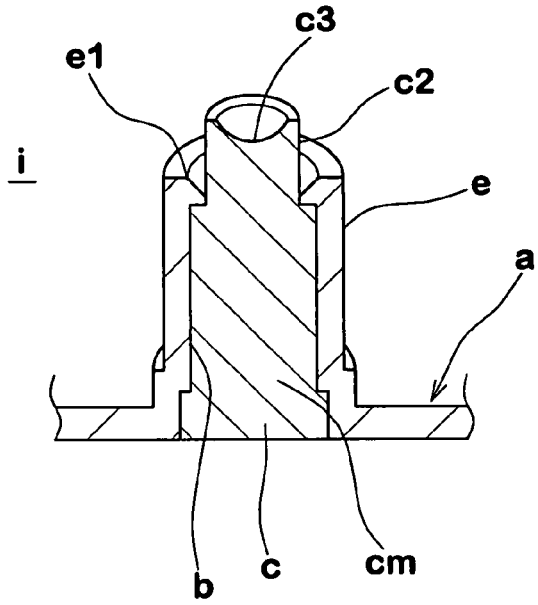
FIG.14(a) PRIOR ART
FIGS. 14(*a*) and 14(*b*) show the prior art.
Figure 14B:
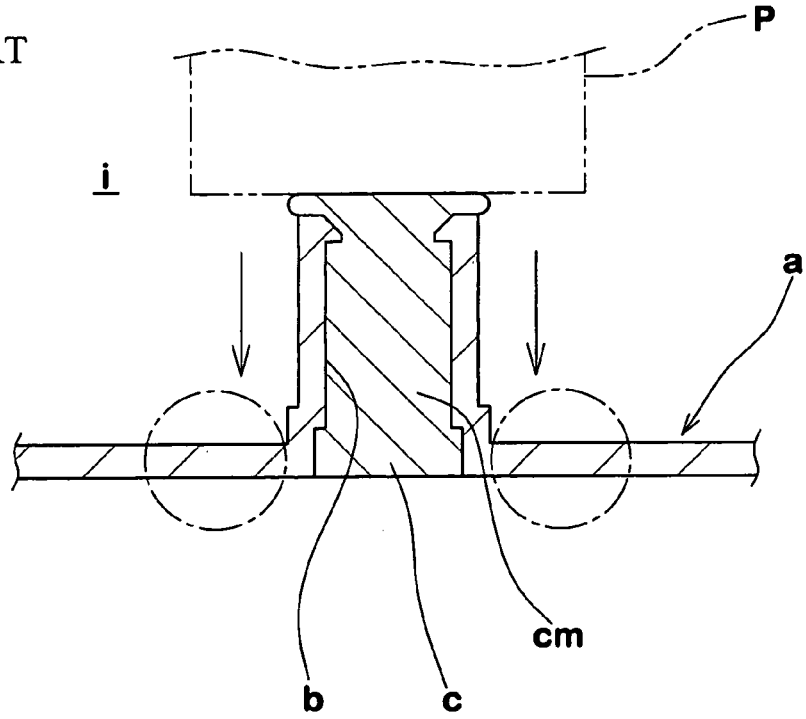
FIG.14(b) PRIOR ART

| Weight member<br>Crush portion | Ex. 1<br>FIG. 4 | Ex. 2<br>FIG. 4 | Ex. 3<br>FIG. 4 | Ex. 4<br>FIG. 4 | Ex. 5<br>FIG. 4 | Ref. 1<br>FIG. 12 | Ref. 2<br>FIG. 13 |
|---|---|---|---|---|---|---|---|
| h (mm) | 0.5 | 0.2 | 1.5 | 0.5 | 0.5 | 1.0 | 1.0 |
| W3 (mm) | 10 | 10 | 10 | 10 | 10 | 10 | 10 |
| W3/h | 20 | 50 | 6.7 | 20 | 20 | 10 | 10 |
| W1 (mm) | 1.0 | 1.0 | 1.0 | 0.5 | 2.0 | 10 | 1.0 |
| W2 (mm) | 8.0 | 8.0 | 8.0 | 9 | 6.0 | 10 | — |
| W2/W1 | 8.0 | 8.0 | 8.0 | 18 | 3.0 | 1.0 | — |
| Engaging force | 100 | 53 | 100 | 73 | 53 | 33 | 50 |
| Fracture (%) | 0.5 | 0.5 | 1.4 | 1.3 | 0.5 | 1.5 | 2 |

As apparent from the test results, in comparison with Ref.1 and Ref.2, Ex.1–Ex.5 show a decrease in the occurrence of fracture and an increased in the engaging force. In addition, as the weight member can fit tightly to the socket by its radial expansion, the weight member was not required to have high accuracy. Therefore, the production efficiency may be greatly improved and also the production cost may be reduced.

In the above-mentioned embodiment, the weight member 1*b* is disposed in the sole portion 4. But, the weight member 1*b* may be disposed in another portion such as the side portion 5 and crown portion 3.

The present invention is suitably applied to a metal wood-type hollow golf club head as described above. But, it can be also applied to other types such as iron-type, patter-type and utility-type.

The invention claimed is:

1. A golf club head comprising a hollow main body provided with a socket, and a weight member disposed in the socket, wherein the socket is a tubular portion having an inner end extending into the inside of the main body and having a through-hole extending therethrough, the weight member including a main portion accommodated in the through-hole, the weight member being secured in the through-hole by crushing a crushable portion, which is formed at the inner end of the main portion of the weight member to protrude from the inner end of the socket into the main body, whereby, upon the application of pressure on the protruding portion of the weight member, the main portion thereof causes the walls of the socket to expand, locking the weight member in the socket, the expansion of the walls of the socket at the inner end being more than 0.3 mm up to 6.0 mm.

2. A method of making a golf club head, containing a main body, a platy part and a weight member, which comprises forming a socket integrally with the platy part, the socket containing a tubular portion which extends from an inner surface of the platy part and having a through-hole extending therethrough, whereby the through-hole has an opening at an outer surface of the platy part and an opening at the inner end of the socket, said weight member having a main portion accommodated in the through-hole, and a crushable portion protruding from the inner end of the main portion to extend a certain distance from the inner end of the socket and from the periphery of the inner end of the main portion, introducing a weight member into the through-hole, and crushing the crushable portion into the main portion, so that the main portion expands, pressing on the surface of the through-hole, whereby the weight member is secured in the through-hole and securing the platy part to the main body.

3. A method of making a golf club head according to claim 2, wherein the main portion of the weight member has the same depth as the through-hole.

4. A method of making a golf club head according to claim 2, wherein the main portion is provided at the inner end with a flat surface surrounding the crush portion.

5. A golf club head comprising a hollow main body provided with a socket, and a weight member disposed in the socket, wherein the socket comprises a tubular portion protruding from an inner surface of the main body into the inside of the main body and having a wall thickness of from about 1.5 mm to about 3.0 mm, and defining a through-hole extending therethrough to have an opening at an outer surface of the main body and an opening at the inner end of the socket, and the weight member includes a main portion accommodated and secured in the through-hole by crushing a crushable portion thereof, wherein the crushable portion is formed at the inner end of the main portion so as to protrude from the inner end of the main portion, and upon the application of pressure thereon is crushed into the inner end of the main portion, causing the inner end of the main portion to expand against the surface of the through-hole, whereby the weight member is locked in the socket.

6. The golf club head according to claim 5, wherein at the inner end of the tubular portion, an enlargement of the cross-sectional shape of the through-hole is caused by the expanding of the inner end of the main portion.

7. A method of making a golf club head, comprising a main body provided in a platy part thereof with a socket and a weight member secured in the socket which comprises, forming the socket integrally with the platy part, wherein the socket includes a tubular portion protruding from an inner surface of the platy part and having a wall thickness of about 1.5 mm to about 3.0 mm, and defining forming the weight member to have a main portion accommodated in the through-hole, and a crushable portion formed at the inner end of the main portion and protruding from the peripheral edge of the inner end of the main portion, inserting the weight member in the through-hole, and crushing the crushable portion by applying a pressure thereto, while supporting the outer end of the weight member whereby the main portion expands, pressing on the surface of the through-hole, causing the weight member to be secured in the through-hole.

8. The method of making a golf club head according to claim 7, wherein the main portion of the weight member has the same depth as the through-hole so that the crushable portion protrudes from the inner end of the socket.

9. The method of making a golf club head according to claim 7, wherein the main portion is provided at the inner end with a flat surface surrounding the crushable portion.

10. The method of making a golf club head according to claim 9, wherein the flat surface surrounding the crushable portion has a width of not more than 0.8 mm.

11. The method of making a golf club head according to claim 9, wherein the flat surface surrounding the crushable portion has a width of not more than 1.5 mm.

12. The method of making a golf club head according to claim 9, wherein, the protruding height of the crushable portion is in a range of from 0.5 to 1.5 mm from the flat surface.

13. The method of making a golf club head according to claim 7, wherein in the tubular portion, the through-hole has a substantially constant cross sectional shape before crushing the crushable portion, but thereafter the cross-sectional shape is slightly enlarged at the inner end of the tubular portion.

14. A golf club head comprising a hollow main body provided with a socket, and a weight member disposed in the socket, wherein the socket is a tubular portion having an inner end extending into the inside of the main body and having a through-hole extending therethrough, the weight member including a main portion accommodated in the through-hole, the weight member being secured in the through-hole by crushing a crushable portion which is formed at the inner end of the main portion of the weight member to protrude from the inner end of the socket into the main body, whereby, upon the application of pressure on the protruding portion of the weight member, the main portion thereof causes the walls of the socket to expand, locking the weight member in the socket, wherein prior to the application of pressure, the weight member protrudes from the inner end of the socket into the main body from 0.5 to 1.5 mm.

15. The golf club head of claim 1 or 14, wherein the inner surface of the socket is provided with a continuous or discontinuous circumferential groove or a plurality of circumferentially arranged holes or dents having a depth of 0.5 to 1.5 mm.

16. A golf club head comprising a hollow main body provided with a socket, and a weight member disposed in the socket, wherein the socket is a tubular portion having an inner end extending into the inside of the main body and having a through-hole extending therethrough, the weight member including a main portion accommodated in the through-hole, the weight member being secured in the through-hole by crushing a crushable portion, which is formed at the inner end of the main portion of the weight member to protrude from the inner end of the socket into the main body, whereby, upon the application of pressure on the protruding portion of the weight member, the main portion thereof causes the walls of the socket to expand, locking the weight member in the socket, the expansion of the walls of the socket at the inner end being more than 0.3 mm up to 6.0 mm wherein the inner surface of the socket is provided with a continuous or discontinuous circumferential groove or a plurality of circumferentially arranged holes or dents having a depth of 0.5 to 1.5 mm.

17. The golf club head of claim 1, 14 or 16, wherein the weight member is a plastically deformable material selected from the group consisting of tungsten, a tungsten alloy, a tungsten-nickel alloy, copper, copper alloy, brass and stainless steel having a specific gravity of from 8 to 20.

18. The golf club head of claim 14 or 16, wherein the expansion of the walls of the socket at the inner end is more than 0.3 mm up to 6.0 mm.

19. The golf club head of claim 1 or 16, wherein prior to the application of pressure, the weight member protrudes from the inner end of the socket into the main body from 0.5 to 1.5 mm.

20. The golf club head of claim 1, 14 or 16, wherein the portion of the weight member which protrudes above the inner end of the socket has a flat portion which surrounds said crushable portion, said flat portion having a width of from 0.8 mm to 2.5 mm.

21. The golf club head of claim 1, 14 or 16, wherein the socket has a wall thickness of about 1.5 to 3.0 mm.

* * * * *